US008038116B2

(12) United States Patent
Lee et al.

(10) Patent No.: US 8,038,116 B2
(45) Date of Patent: Oct. 18, 2011

(54) PORTABLE AND COLLAPSIBLE BOOKSTAND

(76) Inventors: Eunyoung Lee, Daejeon (KR); Dongyoung Kim, Daejeon (KR)

( * ) Notice: Subject to any disclaimer, the term of this patent is extended or adjusted under 35 U.S.C. 154(b) by 0 days.

(21) Appl. No.: 12/624,009

(22) Filed: Nov. 23, 2009

(65) Prior Publication Data

US 2011/0121156 A1 May 26, 2011

(51) Int. Cl.
*A47B 96/07* (2006.01)

(52) U.S. Cl. ..... 248/463; 248/455; 248/460; 248/454

(58) Field of Classification Search ..... 248/452, 248/456, 463, 460, 454, 455
See application file for complete search history.

(56) References Cited

U.S. PATENT DOCUMENTS

| | | | | | |
|---|---|---|---|---|---|
| 706,228 | A * | 8/1902 | Fleming | 248/456 |
| 1,840,620 | A * | 1/1932 | Dennis | 248/462 |
| 1,957,039 | A * | 5/1934 | Buenger et al. | 281/33 |
| 2,014,176 | A * | 9/1935 | Henderson | 248/456 |
| 3,460,795 | A * | 8/1969 | Dahlin | 248/452 |
| 4,466,638 | A * | 8/1984 | Miskin | 281/33 |
| 4,555,128 | A * | 11/1985 | White et al. | 281/45 |
| 4,679,757 | A * | 7/1987 | Mussari | 248/463 |
| 4,886,231 | A | 12/1989 | Doerksen | |
| 5,035,393 | A * | 7/1991 | Menaged | 248/456 |
| 5,607,135 | A * | 3/1997 | Yamada | 248/456 |
| 5,765,799 | A | 6/1998 | Weber | |
| 5,797,578 | A * | 8/1998 | Graffeo et al. | 248/453 |
| 6,045,108 | A * | 4/2000 | Cziraky | 248/454 |
| 6,196,512 | B1 * | 3/2001 | Ure | 248/464 |
| 7,066,437 | B2 | 6/2006 | Iizuka | |
| 7,083,155 | B1 | 8/2006 | Smartt | |
| 7,226,031 | B1 | 6/2007 | Warner | |
| 7,770,864 | B2 * | 8/2010 | Phifer et al. | 248/455 |
| 2005/0121594 | A1 * | 6/2005 | Kuo | 248/676 |

* cited by examiner

*Primary Examiner* — Terrell McKinnon
*Assistant Examiner* — Daniel J Breslin
(74) *Attorney, Agent, or Firm* — Birch, Stewart, Kolasch & Birch, LLP

(57) ABSTRACT

A portable and collapsible bookstand apparatus includes a pair of main panels which is connected by a 180 degree foldable device; a pair of book-holding panels which is connected with the pair of main panels respectively by respective 90 degree foldable devices; a pair of bottom panels which is connected to the main panels respectively by respective 90 degree foldable devices; a plurality of height-control panels which is connected with respective bottom panels by respective 110 degree foldable devices, and are carved and inserted into the respective bottom panels when folded; and a plurality of notches in the main panels for the plurality of height-control panels to be inserted.

10 Claims, 1 Drawing Sheet

PORTABLE AND COLLAPSIBLE BOOKSTAND

BACKGROUND OF THE INVENTION

1. Field of the Invention

The present invention relates to an apparatus for a portable, collapsible, or a foldable bookstand, and to a method of its assembly.

2. Discussion of the Related Art

Although there are many conventional apparatuses regarding portable and collapsible bookstands, there are none which fully satisfies the consumers' demand for one that is simple and stable to use, and is portable and convenient to carry.

But using a proper and convenient bookstand when reading or studying will make such reading or studying more efficient and reduce or prevent strain on eyesight.

Some conventional portable and collapsible bookstands are focused on being portable and collapsible so as to be very compact, but have a face panel, which supports reading materials, such as books, that is either usually small compared to the size of the books or is usually unstable in an open position.

On the other hand, other conventional portable and collapsible bookstands are focused on being stable, but have a wide face panel that is not compact to be conveniently carried when folded.

Accordingly, in order to provide a bookstand that is wide and stable when in use, and is slim and compact when being carried, needed is a new combination of panels, standing structures and folding techniques in addition to proper materials for producing the panels, for a foldable device and for an attachable equipment.

SUMMARY OF THE INVENTION

The main object of the present invention is to provide a portable and collapsible bookstand.

Another object of the present invention is to provide a portable and collapsible bookstand having a wide book-supporting board constructed by a pair of main panel that is stable with a combination of bottom panels and height-control panels.

To achieve these and other objectives, a portable and collapsible bookstand uses 90 degree or 180 degree foldable devices to connect each of panels together; constructs a triangle shaped lattice with a combination of a height-control panel, a bottom panel and the main panel; uses attachable devices such as a magnet at places of necessity on each of the panels to maintain each of the panels firmly in a folded position; and reduces the thickness of the portable and collapsible bookstand to not much more than a combined thickness of each of the main panels when folded.

To achieve these and other objectives, a portable and collapsible bookstand apparatus includes a pair of main panels which is connected by a 180 degree foldable device; a pair of book-holding panels which is connected with the pair of main panels respectively by respective 90 degree foldable devices; a pair of bottom panels which is connected to the main panels respectively by respective 90 degree foldable devices; a plurality of height-control panels which is connected with respective bottom panels by respective 110 degree foldable devices, and are carved and inserted into the respective bottom panels when folded; and a plurality of notches in the main panels for the plurality of height-control panels to be inserted.

It is to be understood that both the foregoing general description and the following detailed description of the present invention are examples and explanatory, and are intended to provide further explanation of the invention as claimed.

DRAWINGS—FIGURES

The accompanying drawings, which are included to provide a further understanding of the invention and are incorporated in and constitute a part of this specification, illustrate embodiments of the invention and together with the description serve to explain the principles of the invention. In the drawings:

FIG. 2 is a front view of a bookstand which is opened to use according to this invention.

FIG. 3 is a side view of a bookstand which is opened to use according to this invention.

FIG. 4 is an isometric view of a bottom panel which has two height-control panels according to this invention FIG. 5 is a front view of a bookstand which is folded according to this invention.

FIG. 6 is a side view of a bookstand which is folded according to this invention.

FIG. 7 is a base view of a bookstand which is folded according to this invention.

DRAWINGS—REFERENCE NUMERALS

Figure 1:
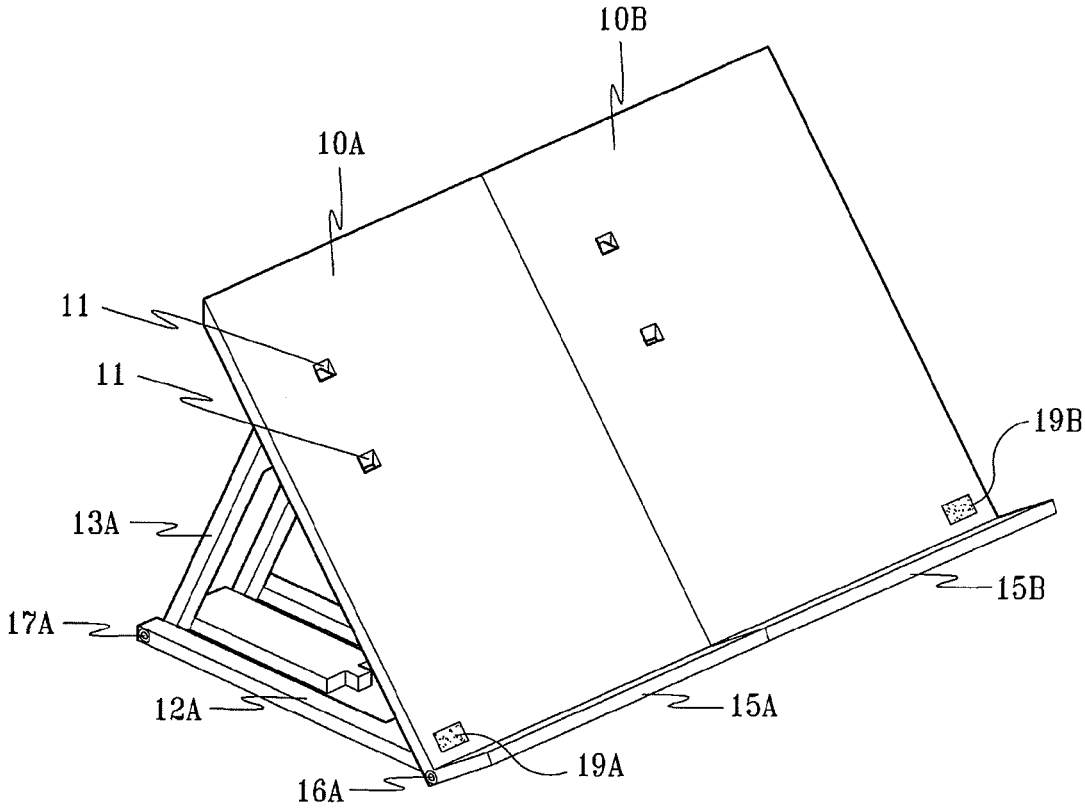
FIG. 1 is an isometric view of a bookstand which is opened to use according to this invention.

10A, 10B main panels
11 holes or notches on the main panels
12A, 12B bottom panels
13A, 13B height-control panels (high)
14A, 14B height-control panels (low)
15A, 15B book-supporting panels
16A, 16B 90 degree foldable device
17A, 17B 110 degree foldable device
18 180 degree foldable device

DETAILED DESCRIPTION OF THE INVENTION

Reference will now be made in detail to the embodiments of the present invention, examples of which are illustrated in the accompanying drawings. Wherever possible, the same reference numbers will be used throughout the drawings to refer to the same or like parts.

Prior to describing the present invention, it should be noted that most terms disclosed in the present invention correspond to general terms well known in the art, but some terms have been selected by the applicants as necessary and will hereinafter be disclosed in the following description of the present invention. Therefore, it is preferable that the terms defined by the applicant be understood on the basis of their meanings in the present invention.

As shown in FIGS. 1-7, a bookstand according to the present invention includes a main panel 10A and another main panel 10B, holes or notches 11 on the main panels 10A and 10B, bottom panels 12A and 12B, a first set of height control panels 13A and 13B, a second set of height control panels 14A and 14B, book-supporting panels 15A and 15B, 90 degree foldable devices 16A and 16B, 110 degree foldable devices 17A and 17B, and an 180 degree foldable device 18. As shown in FIG. 1, the main panels 10A and 10B constitute a book-supporting board in an open position. On this book-supporting board, books or other materials to read will be loaded or supported. The main panel 10A and the main panel 10B are connected by the 180 degree foldable device 18, which makes possible to expand the opened size of the combined main panels 10A and 10B to be double that of each of the main panels taken alone, and to thereby construct the book-supporting board.

The connecting device 18 allows the main panels 10A and 10B to be joined and folded, and can be various known or later developed device as long as its maximum opening degree is about 180°. There are one or more holes or stop marks or notches, indicated as number 11, in the main panels 10A and 10B in order to contact and sustain ends or portions of height-control panels 13A, 13B, 14A and/or 14B. The book-holding panel 15A is connected with the main panel 10A by the 90 degree fordable device 16A. The bottom panel 12A is connected with the main panel 10A and the book-holding panel 15A with the same foldable device 16A, and is also connected with the height-control panel 13A by the fordable device 17A. The end of the height-control panel 13A meets with the main panel 15A at the hole 11. The Bottom panel 12A and the height-control panel 13A together sustain the main panel 10A. The other half of the bookstand is constructed in a similar manner, whereby the other bottom panel 12B and a height-control panel 13B together sustain the main panel 10B, so that a detailed description thereof will not be repeated.

As shown in FIG. 2, the bookstand according to present invention includes a bottom panel 12A connected with the main panel 10A and bottom panel 12B connected with main panel 10B. The connected position of the bottom panel 12A and the main panel 10A do not overlap with the other bottom panel 12B when the main panel 10A and the main panel 10B are folded. In the bottom panel 12A, the height-control panels 13A and 14A are patterned and inserted thereto so that the height-control panels 13A and 14A are inserted or nested in the bottom panel 12A. In FIGS. 1 and 2, the height-control panel 13A is opened and meets with the upper hole 11 in the main panel 10A so the main panel 10A stays in a specific slope with stability.

As shown in FIG. 3, the bookstand according to present invention includes the height-control panel 13A, the main panel 10A and the bottom panel 12A, which make a stable triangle-shaped structure when the bookstand is opened. The slope of main panel 10A can be adjusted by using the different holes 11 and by using the other height-control panel 14A as shown in FIG. 3. In this case, since there are two holes and two height-control panels for each main panel, four different slopes can be attained by making four different assemblies. In other embodiments, different number of holes and different number of height-control panels may be used for greater or lesser amount of height control combination for the main panels.

As shown in FIG. 4, the bottom panel 12A includes the first height-control panel 13A and the second height-control panel 14A. The height-control panels are connected with the bottom panel 12A by the foldable device 17A and all the height-control panels are carved (or patterned) and inserted (or nested) into the bottom panel 12A so when these height-control panels are folded (or nested), the thickness of the folded panels is the one layer of the bottom panel 12A. The shape of the bottom panel 12A, the height-control panels 13A and the height-panel 14A can vary in shape following aesthetic purposes as long as they work the function described in present invention.

As shown in FIG. 5, the bookstand according to present invention, when closed or folded, includes bottom panel 12A and bottom panel 12B which do not exceed the size of the main panel 10A, and do not overlap with each other.

As shown in FIG. 6, the bookstand according to the present invention when closed or folded includes the main panel 10A and the main panel 10B, and the bottom panel 12A and the bottom panel 12B that are located (or sandwiched) between the two main panels 10A and 10B. The book-holding panel 15A and the book-holding panel 15B are attached to the main panel 1 OA and the main panel 10B respectively, but mostly, the total layer of the folded bookstand is compact, and not much more that the combine thicknesses of the two main panels (e.g., three layers). When the main panel 1 OA and the book-holding panel 15A are folded, they may be held in the folded position by attachable devices 19A and 19B, for example, equipped on each panel or other portions of the bookstand. Examples of such attachable devices may be magnets, Velcro, buttons, pins, or other fastening devices. The bottom panels are also attached to the main panels with the help of the attachable devices, which may be equipped on each panel.

As shown in FIG. 7, the bookstand according to the present invention when closed or folded includes bottom panel 12A and bottom panel 12B which do not overlap with each other. This is so since, as shown in FIG. 2, the bottom panel 12A and bottom panel 12B are respectively located on the same side of the main panel 10A and the main panel 10B, and the main panel 10A and the main panel 10B is folded along their attachment portions. At their attachment portions, the main panel 10A and the main panel 10B are connected together by the 180 degree foldable device 18.

In embodiments of the invention, the 90 degree foldable device, the 110 degree foldable device and 180 degree foldable device may be hinges. Also, they may rotate up to about an amount their respective names suggest.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A portable and collapsible bookstand apparatus comprising:

a pair of main panels which is connected by a 180 degree foldable device;

a pair of book-holding panels which is connected with the pair of main panels respectively by respective 90 degree foldable devices;

a pair of bottom panels which is connected to the pair of main panels respectively by the respective 90 degree foldable devices;

a plurality of height-control panels which is connected with respective bottom panels by respective 110 degree foldable devices, and are carved and inserted into the respective bottom panels when folded; and a plurality of notches in the main panels for the plurality of height-control panels to be inserted, wherein the pair of main panels include a first main panel and a second main panel, the pair of bottom panels include a first bottom panel and a second bottom panel, and a side of the first main panel where the first bottom panel is located is the same as a side of the second main panel where the second bottom panel is located, and wherein the pair of bottom panels each includes:

a first end where one of the respective 90 degree foldable devices is located, a second end where one of the respective 110 degree foldable devices is located, and the first and second ends are opposite ends of each bottom panel, and are distal from each other.

2. The apparatus as claimed in claim 1, wherein the pair of main panels connected together by the 180 degree foldable device, when opened, forms a nook-supporting board having a width wide enough to support various sized reading materials.

3. The apparatus as claimed in claim 1, wherein the pair of book-holding panels connected to the pair of main panels by the respective 90 degree foldable devices holds reading materials when opened.

4. The apparatus as claimed in claim 1, wherein, when the main panels are folded, the pair of bottom panels does not overlap with each other.

5. The apparatus as claimed in claim 1, wherein, when the plurality of height-control panels are inserted into the bottom panel, a thickness thereof is only one layer of the bottom panel in total.

6. The apparatus as claimed in claim 1, wherein, when the plurality of height-control panels meets the plurality of notches in the main panels, they maintain a specific slope of the pair of main panels for use.

7. The apparatus as claimed in claim 1, further comprising a plurality of attachable devices equipped on surfaces of the main panels, the book-holding panels, the height-control panels and the bottom panels to maintain these panels in a folded position.

8. The apparatus as claimed in claim 1, wherein, when the main panels are folded, the pair of bottom panels are sandwiched between the pair of main panels.

9. The apparatus as claimed in claim 1, wherein the each bottom panel includes a first height-control panel and a second height-control panel, and the first height-control panel and the second height-control panel are connected to the one of the respective 110 degree foldable devices.

10. The apparatus as claimed in claim 9, wherein the first height-control panel and the second height-control panel are rotatably connected to the one of the respective 110 degree foldable devices.

* * * * *